US010533739B2

(12) United States Patent
Berrel et al.

(10) Patent No.: US 10,533,739 B2
(45) Date of Patent: Jan. 14, 2020

(54) HEADLAMP CONFIGURED TO BE CARRIED AROUND THE NECK

(71) Applicant: Zedel, Crolles (FR)

(72) Inventors: Philippe Berrel, La Chapelle de Bard (FR); Boris Bouffay, Saint Hilaire du Touvet (FR); Sebastien Jarzac, Tencin (FR); Laurent Fruh, Chapareillan (FR)

(73) Assignee: Zedel, Crolles (FR)

( * ) Notice: Subject to any disclaimer, the term of this patent is extended or adjusted under 35 U.S.C. 154(b) by 0 days.

(21) Appl. No.: 15/688,443

(22) Filed: Aug. 28, 2017

(65) Prior Publication Data

US 2018/0058680 A1 Mar. 1, 2018

(30) Foreign Application Priority Data

Aug. 29, 2016 (FR) ..... 16 01269

(51) Int. Cl.
*F21V 33/00* (2006.01)
*F21V 21/14* (2006.01)
*F21V 21/30* (2006.01)

(52) U.S. Cl.
CPC ..... *F21V 33/0004* (2013.01); *F21V 21/145* (2013.01); *F21V 21/30* (2013.01)

(58) Field of Classification Search
USPC ..... 362/105
See application file for complete search history.

(56) References Cited

U.S. PATENT DOCUMENTS

2007/0177376 A1* 8/2007 Simoni ..... F21L 4/00 362/157
2008/0298048 A1 12/2008 Garrity et al.

FOREIGN PATENT DOCUMENTS

CN 103216793 7/2013
FR 2 971 037 8/2012

OTHER PUBLICATIONS

French Search Report, National Appl. No. FR1601269, Applicant: Zedel, End of Search Date: Jun. 22, 2017, 7 pgs, and English language translation, 7 pgs.

* cited by examiner

*Primary Examiner* — Rafferty D Kelly
(74) *Attorney, Agent, or Firm* — Saile Ackerman LLC; Stephen B. Ackerman

(57) ABSTRACT

A headlamp which contains a lamp is disclosed, with a headband enabling the lamp to be held on the head of a user is presented. The headband has a rigid/semi-rigid front section supporting the lamp using a pivot liaison. The pivot liaison allows rotation having: a first amplitude of at least 0 to +30 degrees and preferably 0 to 45 degrees to provide appropriate illumination when the lamp is worn in a conventional manner around the head. A second amplitude ranging from at least 0 to −45 degrees, and preferably 0 to −80 degrees provides appropriate illumination when the lamp is worn around the neck without being inverted. The 0 degree inclination corresponds to the pivot of the lamp which generates a horizontal light beam when the headlamp is positioned on the head of a standing user with the eyes fixing the horizon.

20 Claims, 10 Drawing Sheets

HEADLAMP CONFIGURED TO BE CARRIED AROUND THE NECK

TECHNICAL FIELD

The present invention relates to the field of portable electrical lamps, and more particularly to a headlamp fitted with a rigid or semi rigid headband.

BACKGROUND

Headlamps, such as those originally used by miners, are subject to a great success in the filed of leisure activities, including caving and hiking. They are also widely used professionally.

They are also widely used in the professional field and aim to find multiple new applications.

As shown in FIG. 1 illustrating a conventional headlamp, a lamp 10 is most often associated with an elastic band 11 making it possible to hold the lamp on the head of the user with maximum comfort.

However, such a lamp has the disadvantage of being unsuitable for serving as a light source in circumstances other than those for which it was originally conceived. In particular, when the user bivouacs and shares his meal with another person, the use of the headlamp 10 shows to be inappropriate because it might illuminate and even dazzle the guest who shares his meal with the user.

SUMMARY

In a situation, which is only one example among others, the headlamp does not allow for a use as practical and user-friendly as it could allow.

The present invention aims to improve such situation

It is a first object of the present invention to provide a headlamp offering an improved ergonomic use.

It is another object of the present invention to provide a headlamp which can serve, for practical use, as a "neck" offering a second mode of use which is particularly convenient in situations other than the conventional situations of headlamps.

It is a further object of the present invention to provide a headlamp which allows easy adjustment of the light beam in diverse uses and situations, especially when used as a neck lace or neck strap, or even when the lamp is simply attached to a support, such as a tree branch.

These and other objects are achieved by means of the headlamp which comprises a lamp and a headband enabling a lamp to be held on the head of a user, the headband comprising a rigid/semi-rigid front section supporting the lamp. The lamp is fixed the front section via a pivot liaison which is configured to allow rotation having:

a first amplitude of at least 0 to +30 degrees and preferably 0 to 45 degrees to provide appropriate illumination when the lamp is worn in a conventional manner around the head;

a second amplitude ranging from at least 0 to −45 degrees, and preferably 0 to −80 degrees, to provide appropriate illumination when the lamp is worn around the neck without being inverted;

wherein the 0 degree inclination corresponds to the pivot of the lamp which generates a horizontal light beam when the headlamp is positioned on the head of a standing user with the eyes fixing the horizon.

In one particular embodiment, the headband comprises a more or less rigid/semi-rigid front section and a rear section based on a textile elastic strip, with a coupling between the front section and the rear section being carried out by means of two connecting parts comprising orifices for the passage of electrical wirings. The electrical wirings are advantageously integrated, at the front, in the rigid/semi-rigid front section of the headband, so that the electrical wirings become apparent only at the level of the texte elastic strip only.

Preferably, the headband comprises an alternation of rigid/semi-rigid elements conferring sufficient rigidity on the lamp when it is worn as a "neckstrap" or "necklace", the amplitude of the pivot being [−45°, +30°] and preferably [−80°, +45°] allowing adjustment of the light beam in various positions.

In a particular embodiment, the lamp may be carried around the neck so that the amplitude of the pivot of [−45°, +30°] and preferably [−80°, +45°], allowing large possibilities of adjustment of the light beam, including horizontal illumination, but also downward.

In one particular embodiment, the headlamp comprises a rigid/semi rigid headband which has, at the rear, a battery pack for the electrical supply of the lamp.

Preferably, the headband comprises a hollow tube allowing the passage of a plurality of electrical wires for powering the headlamp.

In one particular embodiment, the rigid/semi rigid headband comprises, at the rear, a signaling light.

Preferably, the headlamp comprises a rigid/semi rigid headband having a fixed length and fixing points for a tightening elastic link. The rigid/semi rigid headband is configured to be deformable thanks to the tightening elastic link.

BRIEF DESCRIPTION OF THE DRAWINGS

Other features of one or more embodiments of the invention will appear from the following description of embodiments of the invention, with reference being made to the accompanying drawings.

DESCRIPTION

There is now described an improved headlamp in that it allows particularly convenient new uses, especially in the neck or when hooked to a support, such as a tree branch.

Figure 1:
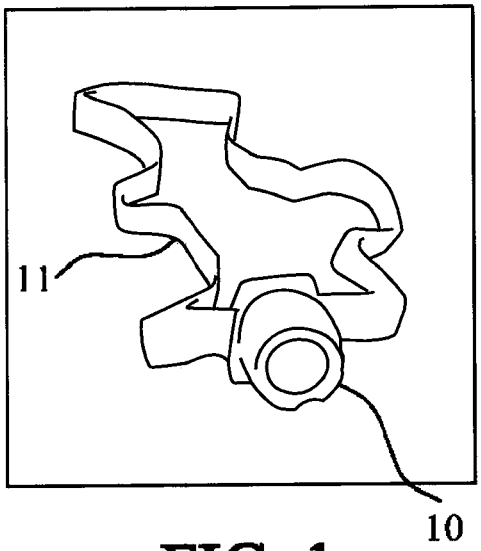
FIG. 1 illustrates a conventional headlamp comprising an elastic headband.
Figure 2:
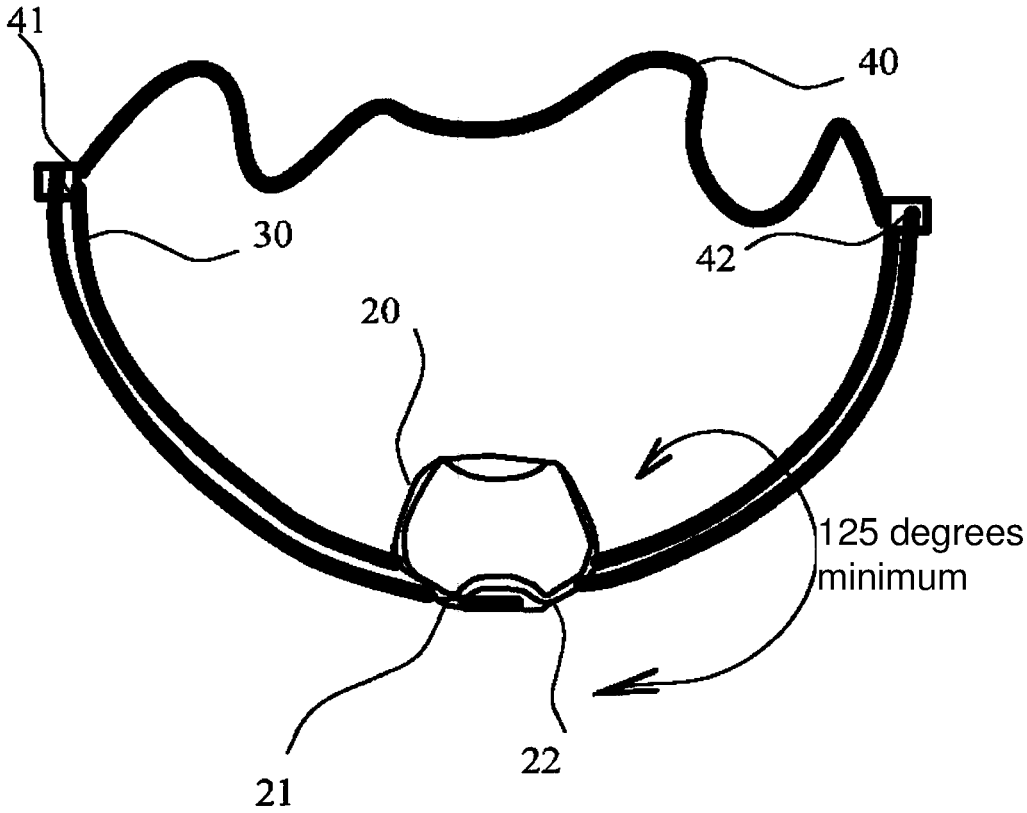
FIG. 2 illustrates one embodiment of a headlamp according to the present invention, based on a rigid/semi rigid headband and fitted with a pivot allowing a rotation of at least 180 degrees.

FIG. 2 illustrates a first embodiment of a headlamp according to the present invention. The headlamp comprises a lamp 20 provided with a light source which is fixed on a headband allowing the headlamp to be held on the head of a user. The headband of FIG. 2 is of mixed nature, comprising a rigid/semi-rigid front section 30 serving as a support for the lamp 20 and a rear section which can be, in a conventional manner, made of an elastic textile 40. The rigid/semi-rigid front section has a pre-curved shape that is sufficiently flexible to accommodate different head shapes. Two pivots 21 and 22, respectively, are disposed on the front section of the headband to allow a possibility of rotation of a wide new range of lamp 20, with respect to the rigid/semi-rigid front section 30.

More specifically, the headband of the lamp 20 is positioned in a conventional manner on the head of a standing user with the eyes fixed towards the horizon and generating a horizontal beam serving as a reference to an inclination of the lamp (Inclination=0°), In one embodiment of the invention, the lamp is configured with a pivot liaison which is able to rotate with a range being at least [−45°, +30°] at least and preferably [−80°, +45°] corresponding to one total amplitude of 125°.

Thanks to this unique arrangement, when the headlamp is positioned on the head of a user, a pivoting of [0, +30°] allows an appropriate adjustment of the light beam. It should be noted that, in this position, the amplitude [−45°, 0°] would not be usable since, in such circumstance, the lamp would tend to "abut" against the front of the user.

Figure 3:
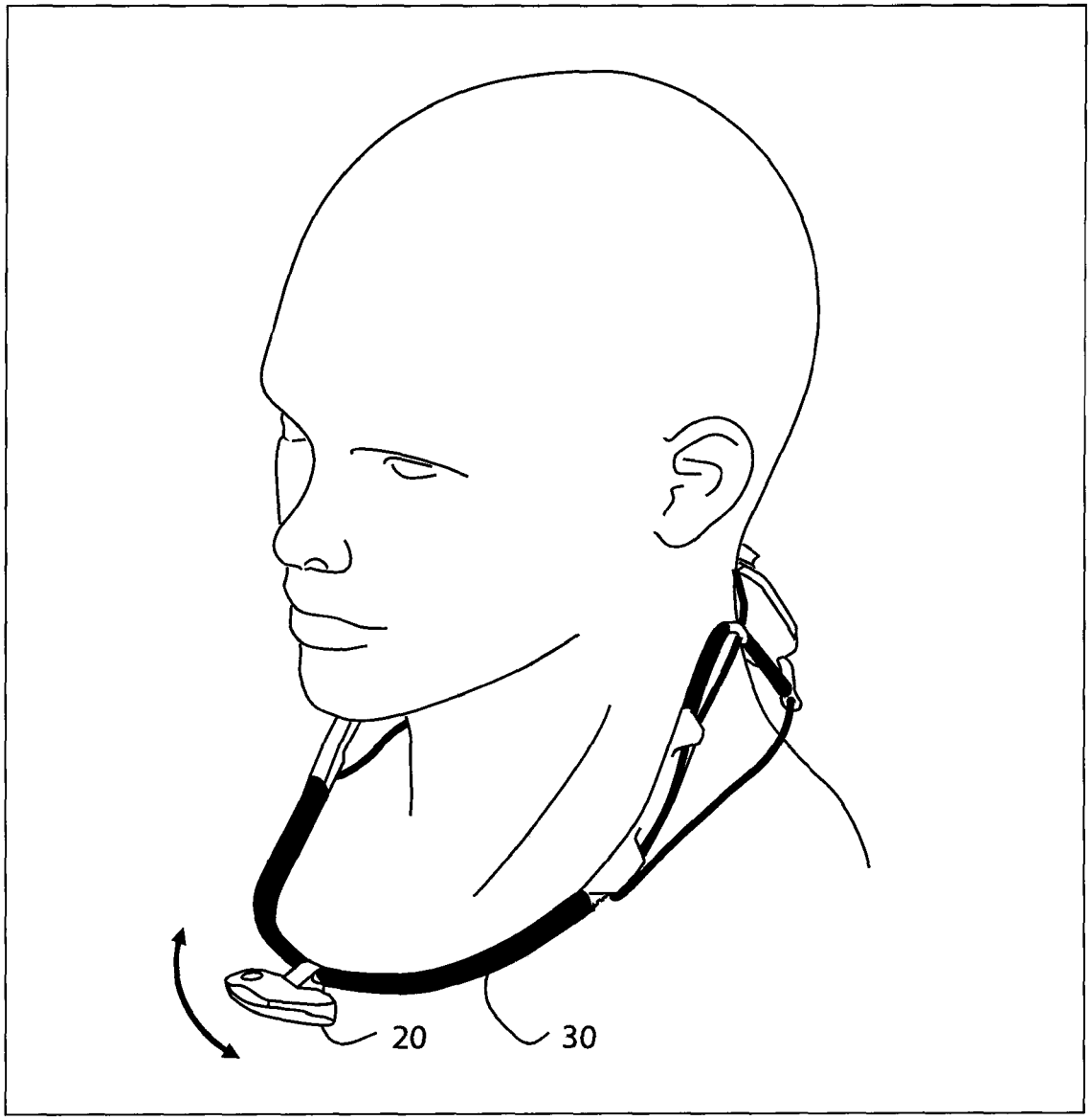
FIG. 3 illustrates an example of use of the embodiment of FIG. 2, in a situation of neck strap or neck lace.

On the other hand, and this is a considerable advantage of the present invention, the headlamp can now be directly positioned, without being "turned upside down", around the neck, in a kind of "neck strap" or "neck lace" configuration, while ensuring proper beam adjustment thanks to the amplitude [−45°, 0°] at least, as illustrated in FIG. 3

Thanks to this particularly timely arrangement, two particularly fruitful technical effects are obtained:

Firstly, a pivot of [−45°, +30°] allows the light beam to be adjusted in a wide range of applications, either as a headlamp or as in a "neck strap" configuration. In either configuration, the user adjusts the light beam so that it illuminates downward or, on the contrary, illuminates it horizontally. The lamp thus becomes usable in two alternative configurations, or even others since the same ease of adjustment becomes possible when the headlamp is hooked to a support.

Secondly, as the pivot is fixed to a front section of a headband which is relatively rigid/semi-rigid, as this is shown in FIG. 2, a high stability of the lamp results even in the so-called "neck strap" or "neck lace" configuration, wherein the lamp can adjusted with precision and ease according to the needs of the user.

As can be seen, the combination of the two means of the invention, a pivot with a large amplitude of at least [−45°, +30°] on a rigid/semi-rigid support, gives the headlamp new possibilities of use.

In a particular embodiment, the headlamp comprises a battery packed fixed in a conventional manner at the rear of the headband, at the level of the elastic textile. Preferably, the rigid/semi-rigid part of the headband is arranged to be hollow so as to allow the accommodation of electrical wirings inside the rigid/semi-rigid front section of the headband. Two connecting elements, respectively 41 and 42 shown in the figure, then allow a coupling between the front section 30 and the elastic textile 40. These two connecting elements also make it possible to leave the electrical conductors out of the rigid/semi part, which can then take the form of a spiral wiring connected via a suitable coupler, to the battery back located at the rear of the headband (and not represented in the figure).

In other embodiments, such as those which will be now described in more detail, and which are illustrated in the following figures, the headband will advantageously take the form of a fully rigid/semi-rigid headband.

Figure 4:
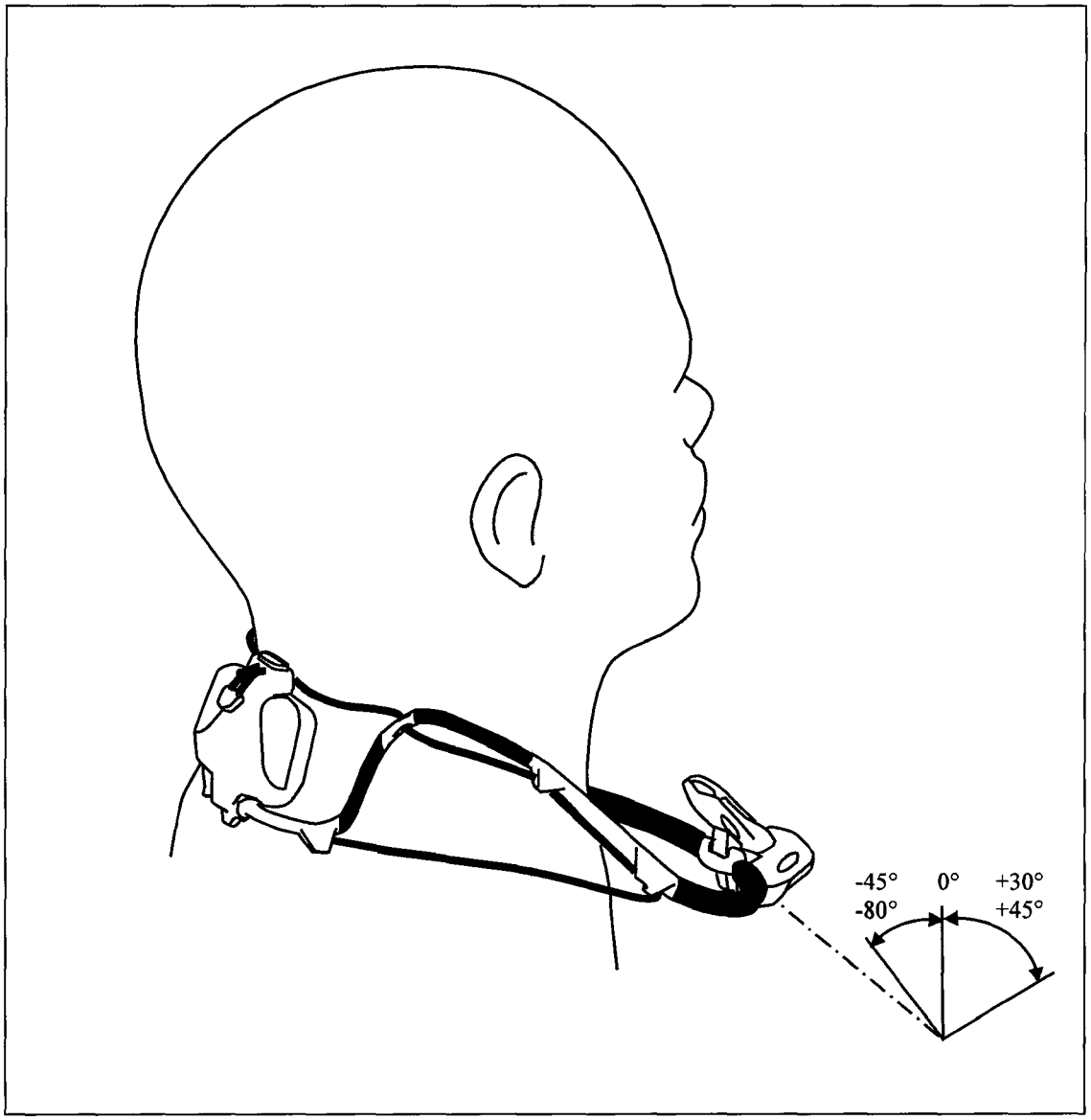
FIG. 4 illustrates a rear right perspective of a mannequin carrying, around his neck as a necklace, one embodiment of a headlamp according to the present invention, wherein the lamp is shown in two distinct pivoting positions.

FIG. 4 illustrates a view from the right of a mannequin carrying, around its neck a second embodiment of a headlamp provided with a rigid/semi-rigid headband according to the present invention, wherein the lamp is shown in two distinct pivot positions.

Figure 5:
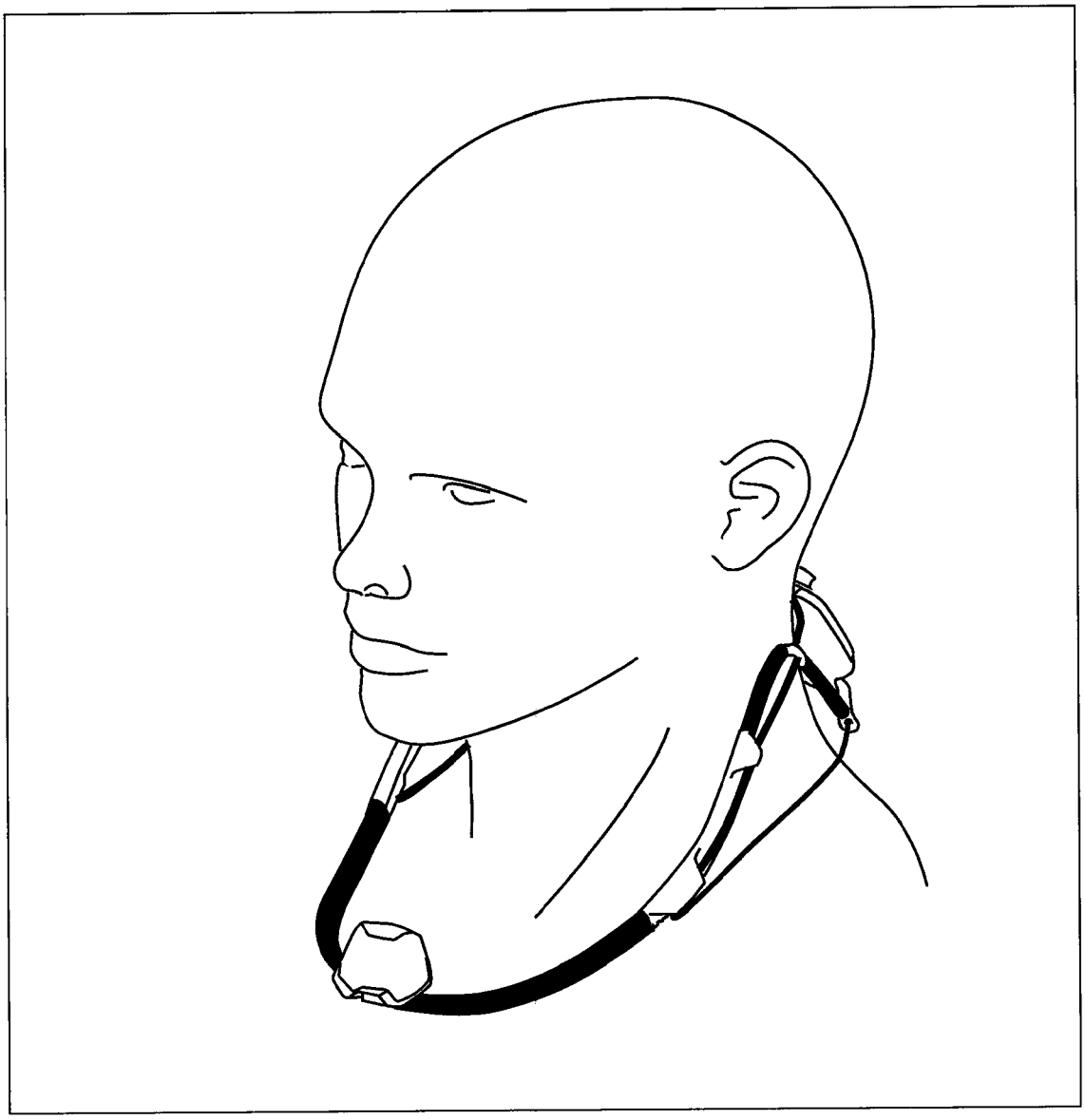
FIG. 5 illustrates a left view of a mannequin carrying, around his neck, an embodiment of a headlamp according to the present invention.

FIG. 5 illustrates a view seen from the left of a mannequin carrying, around its neck, an embodiment of a headlamp according to the present invention.

Figure 6A:
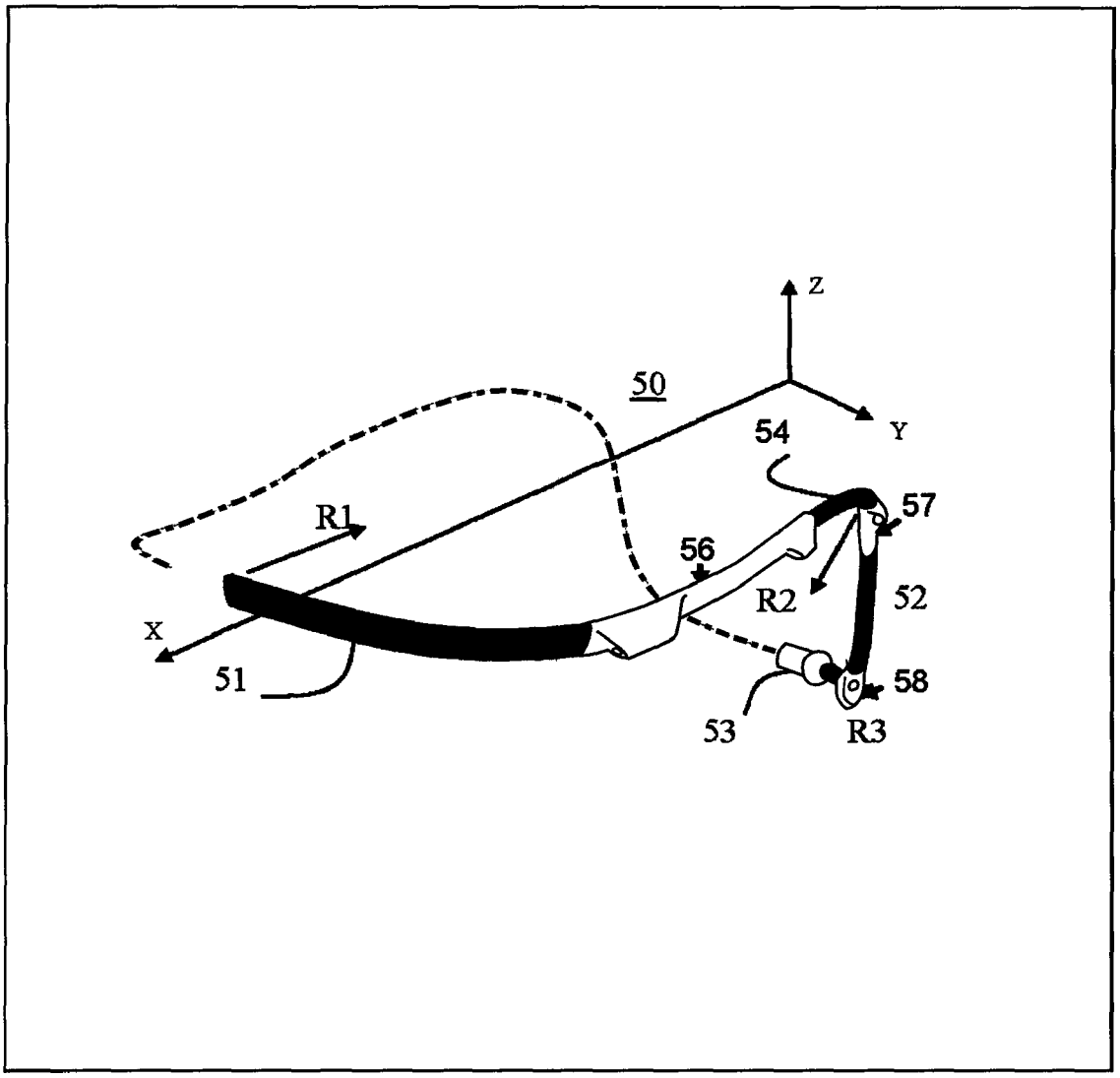
FIG. 6*a* illustrates a second embodiment of a rigid/semi rigid headband according to the present invention, which allows the headband to be adjusted to several sizes and shapes of head.

FIG. 6*a* illustrates a second embodiment of a rigid/semi-rigid headband 50 of a headlamp having a "rear" section which goes down before going through the median sagittal plane. More specifically, the headband comprises a front section which is rigid/semi-rigid, allowing fixing of a lamp via a pivot connection, and which is located approximately in a horizontal plane (x, y) corresponding to a transverse plane with respect to the lamp holder. In a first approximation, the radius of curvature R1 of the curve 11 is represented, which lies in the (x, y) plane.

Behind the front section—towards the right part in FIG. 6*a*—one sees that the headband 50 then follows a side curve which is approximately in a vertical plane (x, z) which is parallel to the sagittal plane of the user and, again, the approximation of the radius of curvature R2 is shown.

Backward, the headband 20 follows a rear curve which approximately fits in a plane (y, z) corresponding to the frontal plane with respect to the lamp user and FIG. 6*a* illustrates the approximation of a radius of "curvature" equal to R3 . . . .

Therefore, the median sagittal plane serves as a plane of symmetry and the dotted part corresponds to the part of the headband situated "behind" the median sagittal plane.

It can be seen that the rear section of the second embodiment of the headband 50 "goes down" before meeting the median sagittal plane. This is only one non limiting example of an embodiment of a fully rigid/semi rigid headband.

The headband 50 thus comprises:

a rigid/semi-rigid front section for fixing a lamp 101 and providing a certain deformability along a first plane (x, y) which is a transverse plane;

a rigid/semi-rigid intermediate lateral section allowing a certain deformability along a second plane (x, z) which is a sagittal plane;

A rigid/semi-rigid rear section providing certain deformability along a third plane (y, z) which is a frontal plane.

By means of this advantageous arrangement, one achieves a three-dimensional shape which is deformable, within any one of the above plans, while preserving a constant length for the headband 50.

In a particular embodiment, the headband 50 comprises an alternation of rigid/semi-rigid (deformable) elements. The rigid elements are illustrated in the clear in the figure while the semi-rigid (deformable) elements are shown in dark. As it can be seen, the headband 50 of FIG. 6*a* comprises a left branch fitted with a deformable semi-rigid front section 51 (in dark) and then, from left to right:

A rigid lateral section 56 (clear),

A semi-rigid lateral section 54 (dark),

A rigid lateral section 57 (clear),

A semi-rigid lateral section 52 (dark),

A rigid lateral section 58 (clear),

A semi-rigid rear section 53 (dark).

As it can be seen in this specific embodiment, the front section 21, the lateral sections 54 and 52 and the rear section 53 which are all semi-rigid, allow the deformation of the headband of constant length in the three (x, y), (x, Z) and (y, z) planes. Thus causing the variability of the radii of curvatures R1, R2 and R3 enabling the fastening of the headband 50 to a head of any shape and size, as it can be seen in FIG. 6*b*.

Figure 6B:
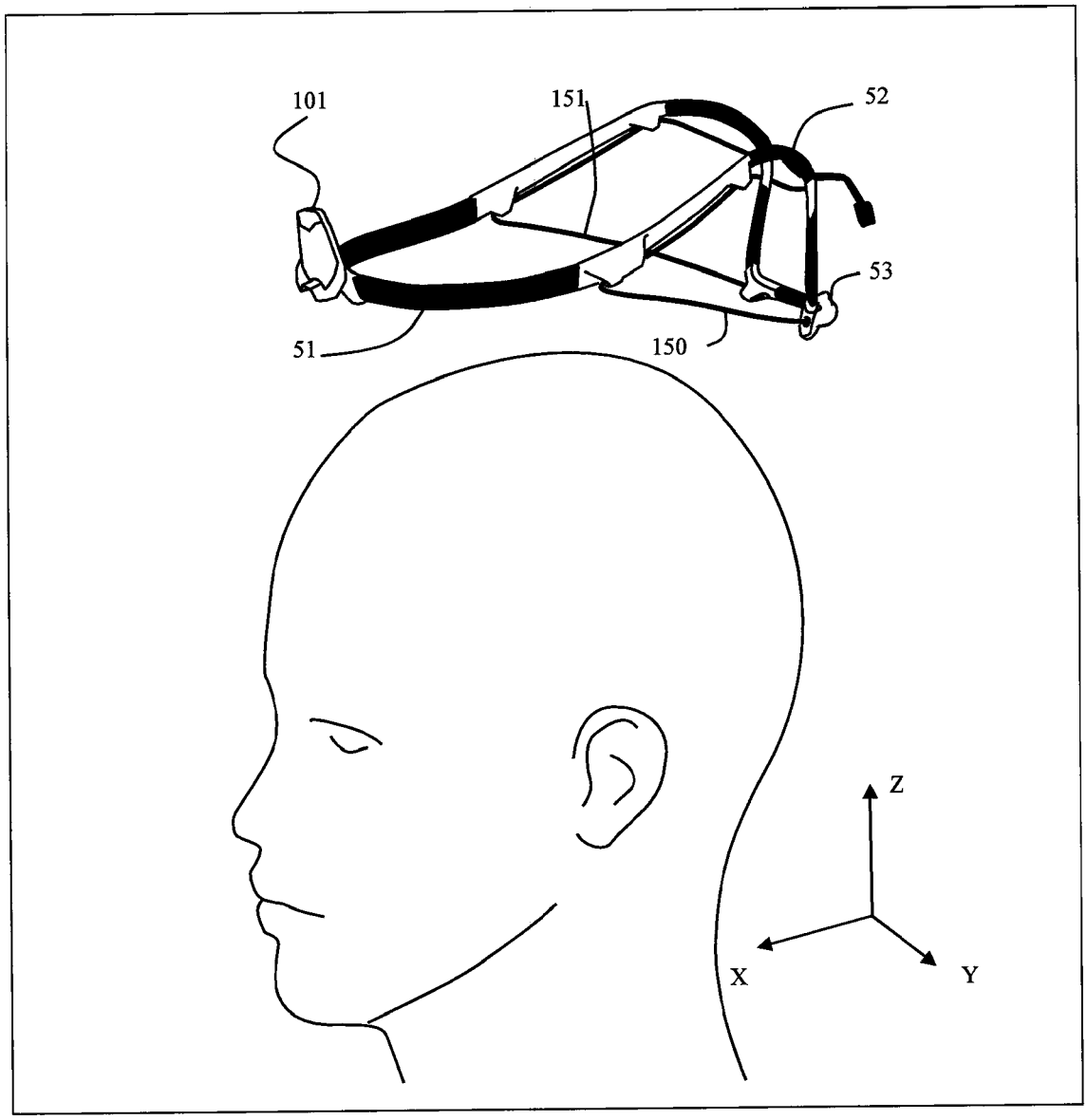
FIG. 6*b* illustrates an example of realization of the second embodiment when carried on the user's head.

It can also be seen in FIG. 6*b* that the headband 50 comprises rigid elements permitting the fixing and the passage of an elastic link, 150 and 151 respectively, in order to ensure tightening making it possible to constrain the deformation of the rigid/semi-rigid headband according to the three planes, reducing the radii of curvatures R1-R3, as shown in the diagram of FIG. 6*a*.

Figure 7:
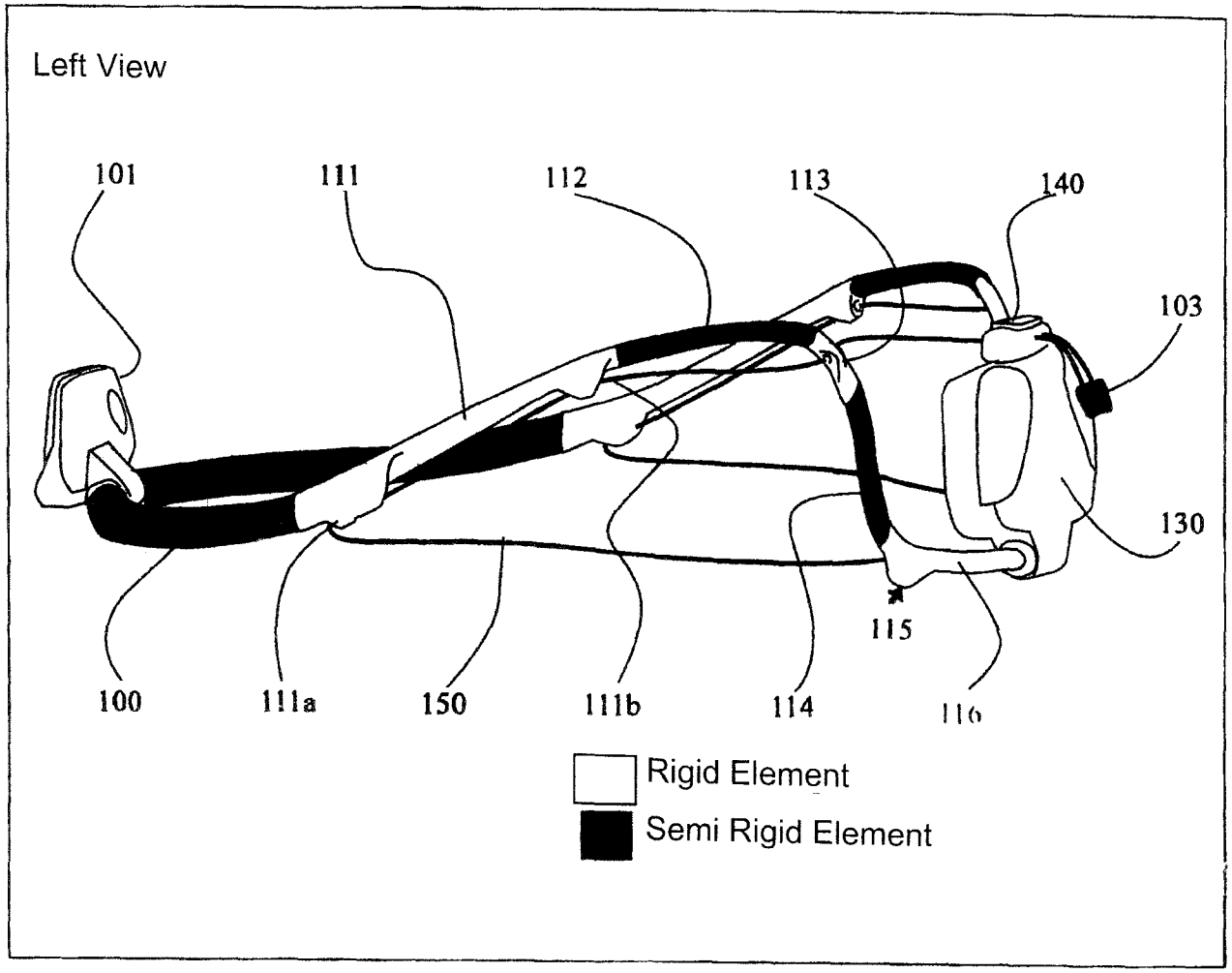
FIG. 7 illustrates the detail of a left view of a rigid/semi rigid headband of the second embodiment of the headlamp.
Figure 8:
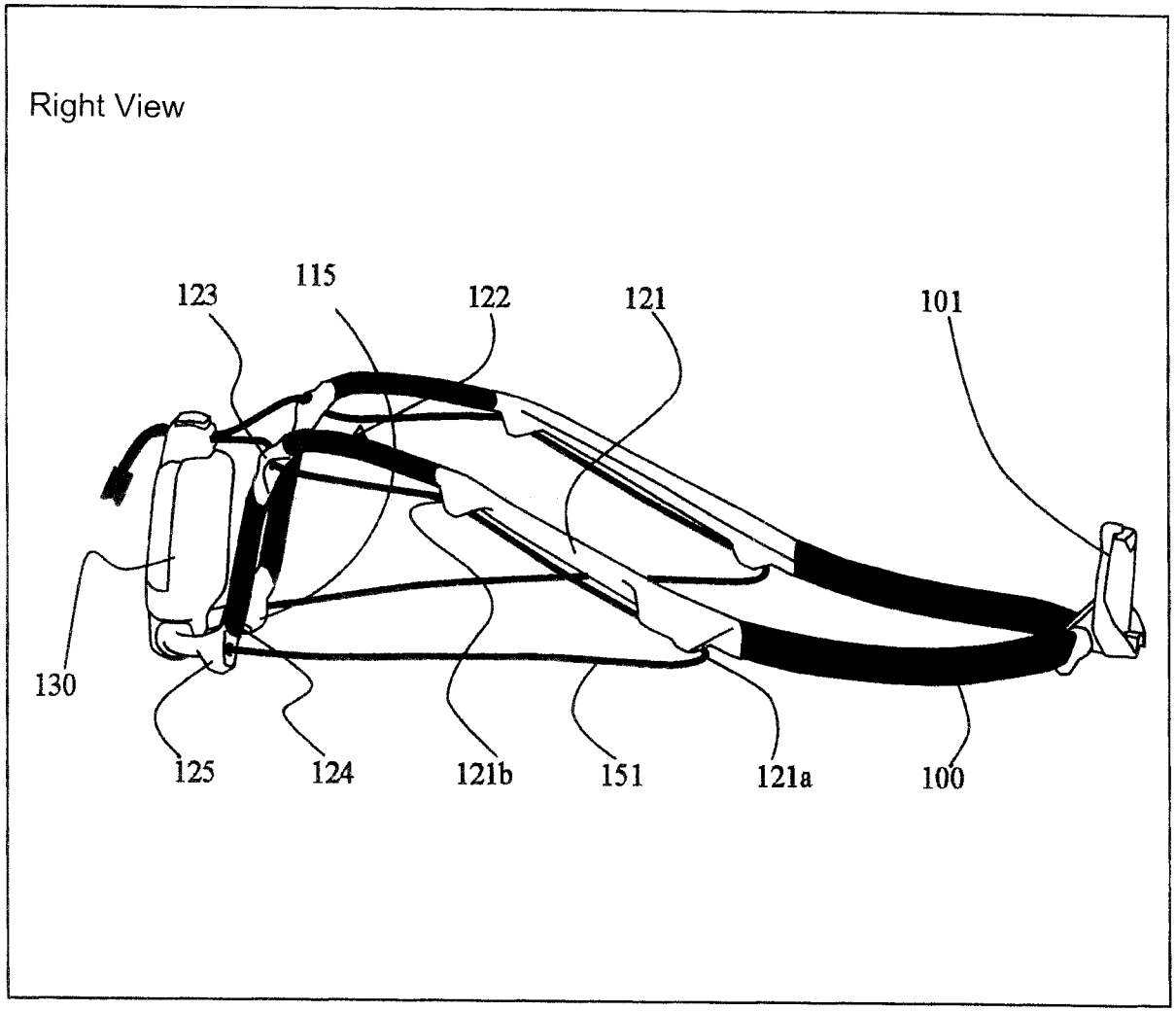
FIG. 8 illustrates the detail of a right view of a rigid/semi rigid headband of the second embodiment of the headlamp.

FIGS. 7 and 8 illustrate the detail of a concrete embodiment of a rigid/semi-rigid headband according to the second embodiment. The headband comprises an alternation of rigid elements, shown in clear in FIGS. 7 and 8, and of more flexible elements which are shown in the dark.

In a particular embodiment, the elements may be made of thermoplastic polyurethane (TPU) or of polyamide, polyester, PVC with grades chosen to allow the construction of a rigid/semi-rigid structure with a stable structure (allowing even the positioning of the headband on a table) while being sufficiently deformable by means of elastic link 150. In practice, the more rigid elements will have a grade in the range [73SHD] whereas the less rigid elements (semi-rigid) shall have a grade within the range of [70 Sh A].

Referring to FIG. 7 which more specifically shows a left-hand view of the headband, the latter comprises a semi-rigid front section 100 on which will be fixed, via a pivot liaison, a lamp 101 comprising one or more LEDs associated with its electronic circuit. The front section can be extruded. Preferably, the lamp 101 comprises a plurality of medium power LEDs, and their associated optics. As a result, the lamp will take a relatively flat shape, with a large heat dissipation surface, which will enable the LEDs to be placed directly on a printed circuit acting as a radiator. This will result in a particularly compact lamp 101.

The headband further comprises a rigid (clear) rear section 116 forming a rear part of the headband. Alternatively, element 116 may become semi-rigid to fit on the xy plane.

Headband 20 comprises, on its left branch, a first rigid element 111 (of greater rigidity than the semi-rigid element 100) having a first lower end fixed to a first end of the front section 100, and a second upper end attached to a second semi-rigid element (dark, therefore more flexible). The rigid element 111 comprises at its two lower and upper ends, respectively, two traversing holes 111*a* and 111*b* which are configured for receiving a first tightening elastic link 150.

The second semi-rigid element 112 has a first end fixed to the second end of first element 111 and a second end fixed to a first end of a third rigid element 113 serving as a point of passage for the elastic link 150 coming from the second element 111*b* belonging to the left branch.

The headband then comprises a fourth flexible (semi-rigid) element 114 having a first upper end fixed to a second end of the third element 113 and a second end fixed to a fifth rigid element 115 enabling the fastening of the first elastic link 150 coming from the traversing hole 111*a*.

It will be noted that, according to the embodiment being considered, the rear section 116 may be rigid or semi-rigid so that the elements 115 and 116 can or can note formed from a same manufacturing process. When the rear part 116 is semi-rigid (represented in dark), then the fifth rigid element 115 will be distinct from the latter. On the contrary, if the rear part 116 is rigid, the elements 115 and 116 may be identical or resulting from the same manufacturing process.

The left branch of the headband is finally fastened to a first end of the rigid or semi-rigid element 116 forming the rear part of the rigid/semi-rigid headband, via a second end of the rigid element 115.

FIG. 8 illustrates the detail of the right branch of the headband, which, as can be seen, is perfectly symmetrical with respect to the left branch. One can see in FIG. 8 that the right branch includes a sixth rigid element 121 having a first lower end attached to a second end of the front section 100 and a second upper end attached to a first end of a seventh flexible element (semi-rigid) 122. The rigid element 121 has, at its two lower and upper ends, two passage holes 121*a* and 121*b* which are configured for receiving a second tightening elastic link 151.

The flexible element 122 comprises a first end fixed to the element 121 and a second end fixed to a eighth rigid element 123 serving as a point of passage for the elastic link 151 coming from the elements 121*b* of the left branch.

The headband then comprises a ninth flexible (semi-rigid) element 124 having a first upper end fixed to a second end of the element 123 and a second lower end fixed at a first end of a tenth rigid element 125 and allowing the fastening of the second elastic link 151 coming from the passage hole 121*a*.

The right branch of the headband is finally attached to the rear (semi-rigid) element 116 which forms the rear of the rigid/semi-rigid headband via a second end of the rigid element 125.

Figure 9A:
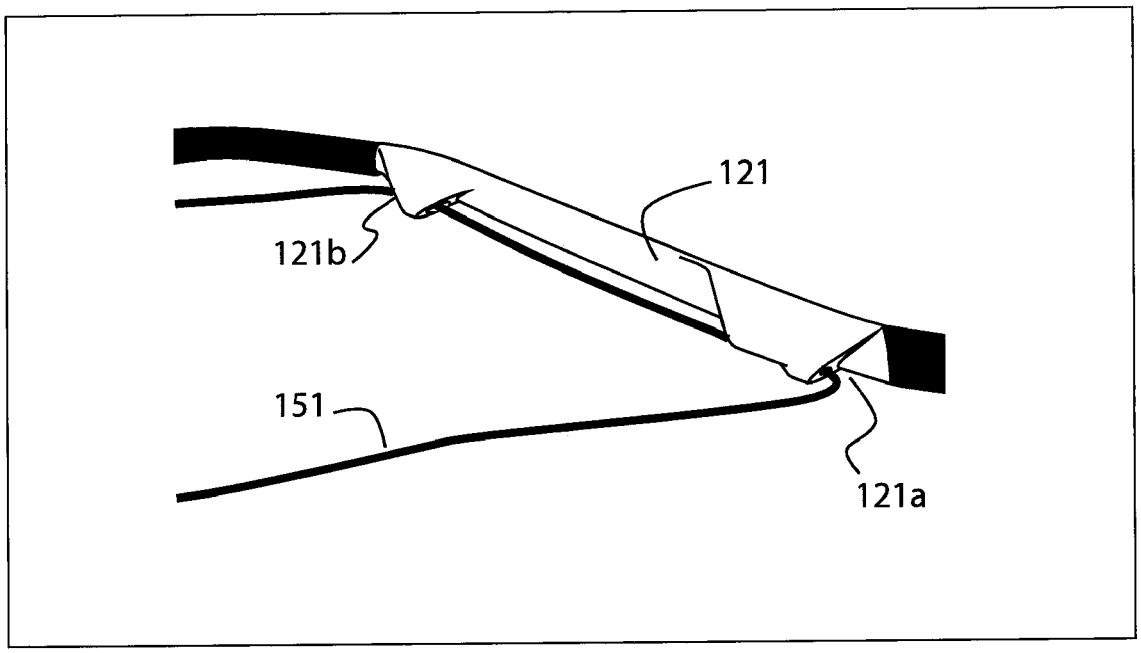
FIG. 9*a* illustrates one specific detail of one rigid element of the headband, allowing the passage of the tightening elastic link.

FIG. 9*a* illustrates the detail of rigid element 121 having, at its two ends 121*a* and 121*b*, the passage holes which are configured to receive the elastic link 151 allowing the strain on the radius of curvature R2 and, consequently, the deformation of the headband within the sagittal plane (x, z)

Figure 9B:
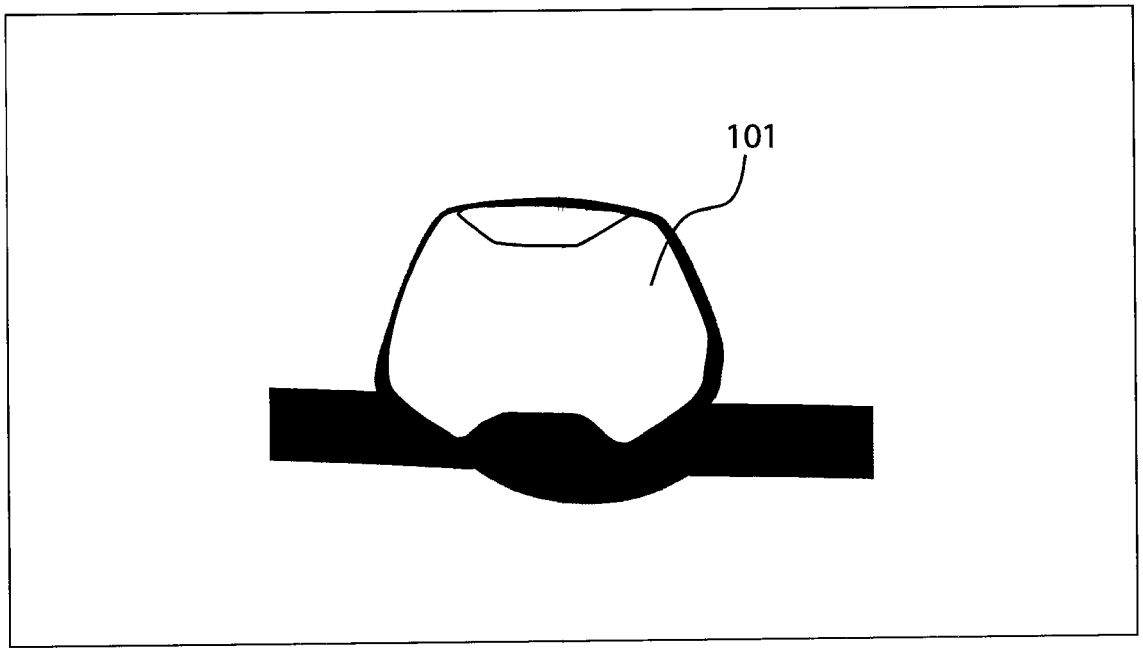
FIG. 9*b* shows one embodiment of a headlamp and its pivot of 180 degrees on the rigid/semi rigid element of the headband.

FIG. 9*b* illustrates an embodiment of a lamp 101 attached to the semi-rigid front section of the headband by means of a pivot having a large amplitude—at least equal to [−45°, +30°]—on a rigid element at the front of the headband. This pivot function of a wide amplitude makes it possible, as will be seen hereinafter, to allow a further adjustment of the headlamp when it is used as a "neck strap" or "necklace". More precisely, the pivot of the headlamp is advantageously configured to allow a rotation of approximately 90°, which allows a better adaptability to the morphology of the lamp holder and thus improves comfort. This rotation also makes it possible to considerably increase the balance of the lamp when it is placed on a table for example.

Figure 10:
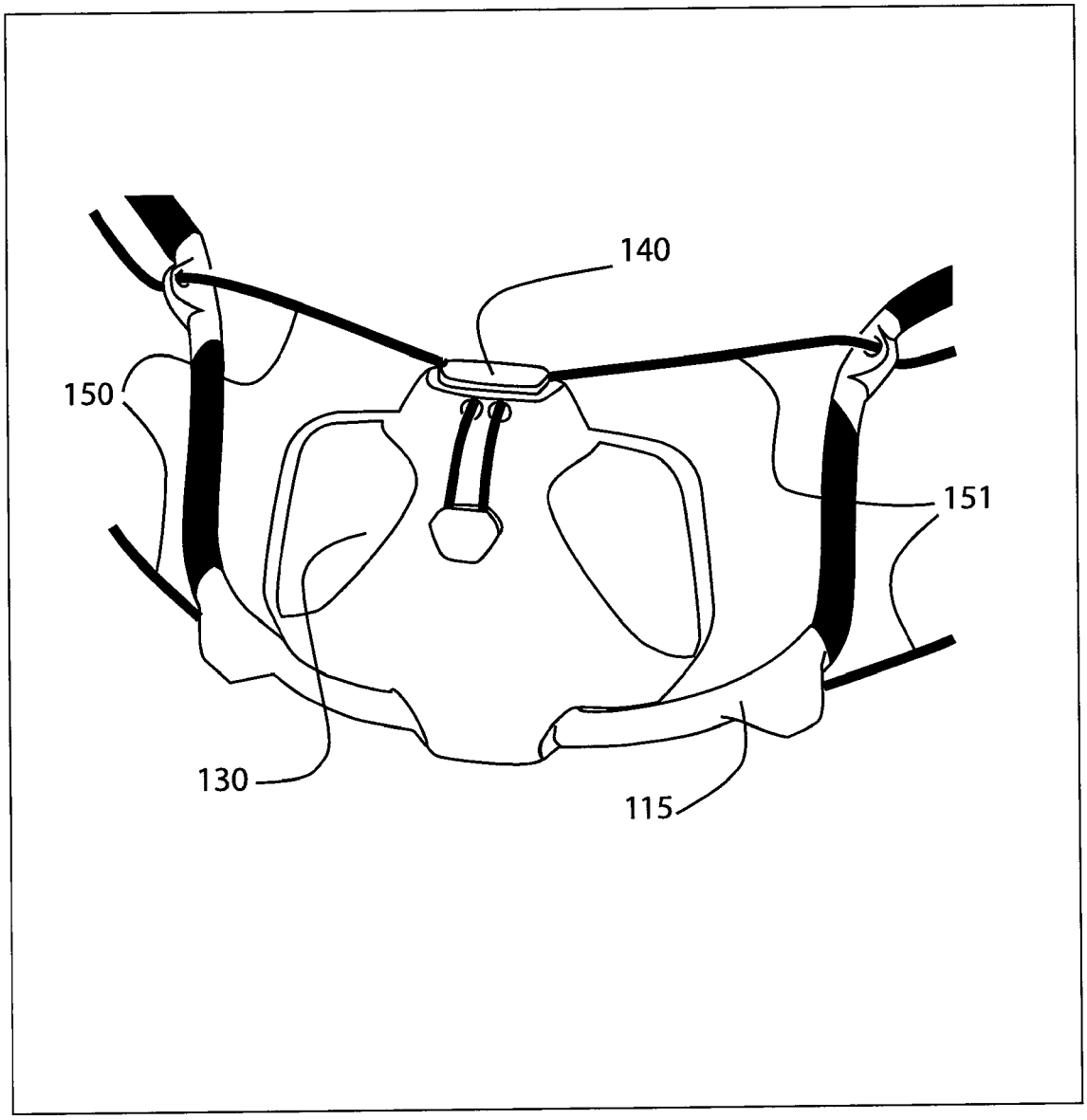
FIG. 10 illustrates the detail of a rear part of the rigid/semi rigid headband on which is fixed a battery pack of the headlamp as well as the system configure for fixing the tightening elastic link.

In a particular embodiment, the headband illustrated in FIGS. 7 and 8 comprises, at the rear, a powering battery pack 130 for supplying current to the lamp 101. Preferably, the battery pack comprises, at the top, a passage hole for the elastic link 150 and 151 with a locking button 140. FIG. 10 illustrates a rear view of the headband clearly showing the battery pack 130, the passage hole for the elastic link 150 and 151 and the locking button 140. In the diagram of FIG. 10, it can be seen that the rear part 116 is made of a rigid material such as the element 116, so that the two elements 115 and 116 are made from the same manufacturing process. However, this is only a particular embodiment because, once again, the element 116 may optionally be made of a semi-rigid material.

As can be seen, the headband forms an overall structure consisting of an alternation of rigid and semi-rigid elements, which is relatively stable since it can be placed on a table in the manner of any object. In this way, the headlamp can be used as a table lamp. Furthermore, the flexibility of the flexible elements allows deformability of the headband in the space which is achieved by the tightening of the elastic links 150 and 151 and their blocking at the locking button 140 located on the top of the battery which, can pivot backwards as required.

One can thus achieve a new headband which shows a new look, a quite new and original appearance that is likely to please new categories of consumers, potentially repulsed by the "tool" aspect of traditional headlamps.

Moreover, this new type of rigid/semi-rigid headband offers multiple new functionalities, as will be seen at present.

In a particular embodiment, the left and/or right branches of the headband are hollow and their constant length makes it possible to integrate therein a plurality of electrical conductors and/or optical fibers. This eliminates in a particularly elegant and functional manner, the apparent electrical wires known in conventional headlamps with a elastic headband having variable length. The space will be sufficient to integrate, within the rigid/flexible elements, power conductors and control conductors which will thus be particularly well protected therein.

In a particular embodiment, the headband comprises a rear light allowing the lamp holder to be signaled. This rear signaling can be generated by means of a secondary lamp attached to the battery pack 130 or, alternatively, by deviating part of the light produced by the lamp 101 thanks to one or more optical fibers. Advantageously, light can thus be deviated from the front part of the headband to the rear part. Conversely, it is also possible to combine a light source in the rear case (red) with a set of optical fibers in order to deport a fraction of the light (red) generated by the rear case to the front or towards the side.

In a particular embodiment, the front section 100, or even the rigid branches 111 and 121, are equipped with switches for controlling the functionalities of the lamp, which certainly did not offer the conventional headlamps. Alternatively and/or cumulatively, one or more displays can be provided enabling an advantageous human-machine Interface (HMI) to be achieved.

In another particular embodiment, the left and right branches of the headband are designed to be luminous so as to allow effective lateral signaling of the lamp holder.

What is claimed is:

1. Headlamp comprising:

a lamp;

a headband enabling said lamp to be held on the head of a user, said headband comprising a rigid/semi-rigid front section sufficiently flexible to adapt to different shapes of heads of different users, wherein said lamp is fixed on said front section via a pivot liaison, said pivot liaison is configured to allow rotation having:

a first amplitude of at least 0 to +30 degrees and preferably 0 to +45 degrees to be used when the lamp is worn in a conventional manner around the head, wherein said lamp provides illumination in front of the user when said pivot is rotated within said first amplitude;

a second amplitude ranging from at least 0 to −45 degrees, and preferably 0 to −80 degrees, to be used when the lamp is worn around the neck without being inverted, wherein said lamp still provides illumination in front of the user when said pivot liason is rotated within said second amplitude;

wherein the 0 degree inclination corresponds to the pivot of the lamp which generates a horizontal light beam when the headlamp is positioned on the head of a standing user with the eyes fixed on the horizon;

wherein said second amplitude of at least 0 to −45 degrees is unusable when the headlamp is positioned on the head because it would tend to cause the lamp to abut against the user's front but on the other hand allows adjustment of the light beam when the lamp is positioned around the neck.

2. The headlamp according to claim 1, wherein the headband comprises a rigid/semi-rigid front section which has a flexible pre-curved shape adaptable to different shapes of heads, and a rear section made with an elastic textile headband, the connection between the front section and the rear section being provided by two connecting parts comprising orifices for the passage of electrical wirings, wherein said electrical wirings are integrated at the front in the rigid/semi-rigid front section of the headband, wherein the flexible pre-curved section provides stability to the lamp when worn around the neck.

3. The headlamp according to claim 1, wherein the headband comprises an alternation of rigid/semi-rigid elements giving sufficient rigidity to the lamp when it is worn as a "neck strap" or a "neck lace", the pivot of 180 degrees being configured to allow adjustment of the light beam in various positions.

4. The headlamp according to claim 1, wherein the pivot is configured to allow adjustment of the light beam of the lamp for horizontal illumination but also upwards when the lamp is worn around the neck.

5. The headlamp according to claim 1, wherein the rigid/semi-rigid headband comprises, at the rear, a battery pack for the electrical supply of the lamp.

6. The headlamp according to claim 5, wherein said rigid/semi rigid headband comprises a hollow tube allowing the passage of a plurality of electrical wires for powering the headlamp.

7. The headlamp according to claim 1 wherein the rigid/semi rigid headband comprises, at the rear, a signaling light.

8. The headlamp according to claim 1, wherein said rigid/semi-rigid headband is a headband having a fixed length and has attachment points for a tightening elastic link, said rigid/semi-rigid headband being configured to be deformable due to the tightening elastic link.

9. The headlamp according to claim 1, wherein said rigid/semi-rigid band comprises a hollow tube allowing the passage of a plurality of electrical wires enabling electrical power supply to the headlamp.

10. The headlamp according to claim 1, wherein said rigid/semi-rigid headband comprises a hollow tube allowing the passage of one or more optical fibers.

11. A method of producing a headlamp comprising the steps of:

providing a lamp;

providing a headband enabling said lamp to be held on the head of a user, said headband comprising a rigid/semi-rigid front section sufficiently flexible to adapt to different shapes of heads of different users, wherein said lamp is fixed on said front section via a pivot liaison, said pivot liaison allows rotation having:

a first amplitude of at least 0 to +30 degrees and preferably 0 to +45 degrees to to be used when the lamp is worn in a conventional manner around the head, wherein said lamp provides illumination in front of the user when said pivot is rotated within said first amplitude;

a second amplitude ranging from at least 0 to −45 degrees, and preferably 0 to −80 degrees, to be used when the lamp is worn around the neck without being inverted, wherein said lamp still provides illumination in front of the user when said pivot liason is rotated within said second amplitude;

wherein the 0 degree inclination corresponds to the pivot of the lamp which generates a horizontal light beam when the headlamp is positioned on the head of a standing user with the eyes fixed on the horizon;

wherein said second amplitude of at least 0 to −45 degrees is unusable when the headlamp is positioned on the head because it would tend to cause the lamp to abut against the user's front but on the other hand allows adjustment of the light beam when the lamp is positioned around the neck.

12. The method according to claim 11, wherein the headband comprises a rigid/semi-rigid front section which has a flexible pre-curved shape adaptable to different shapes of heads, and a rear section made with an elastic textile headband, the connection between the front section and the rear section being provided by two connecting parts comprising orifices for the passage of electrical wirings, wherein said electrical wirings are integrated at the front in the rigid/semi-rigid front section of the headband, wherein the flexible pre-curved section provides stability to the lamp when worn around the neck.

13. The method according to claim 11, wherein the headband comprises an alternation of rigid/semi-rigid elements giving sufficient rigidity to the lamp when it is worn as a "neck strap" or a "neck lace", the pivot of 180 degrees allowing adjustment of the light beam in various positions.

14. The method according to claim 11, wherein the pivot allows adjustment of the light beam of the lamp for horizontal illumination but also upwards when the lamp is worn around the neck.

15. The method according to claim 11, wherein the rigid/semi-rigid headband comprises, at the rear, a battery pack for the electrical supply of the lamp.

16. The method according to claim 15, wherein said rigid/semi rigid headband comprises a hollow tube allowing the passage of a plurality of electrical wires for powering the headlamp.

17. The method according to claim 11 wherein the rigid/semi rigid headband comprises, at the rear, a signaling light.

18. The method according to claim 11, wherein said rigid/semi-rigid headband is a headband having a fixed length and has attachment points for a tightening elastic link, said rigid/semi-rigid headband is deformable due to the tightening elastic link.

19. The method according to claim 11, wherein said rigid/semi-rigid band comprises a hollow tube allowing the passage of a plurality of electrical wires enabling electrical power supply to the headlamp.

20. The method according to claim 11, wherein said rigid/semi-rigid headband comprises a hollow tube allowing the passage of one or more optical fibers.

* * * * *